US010483020B1

(12) United States Patent
Good

(10) Patent No.: US 10,483,020 B1
(45) Date of Patent: Nov. 19, 2019

(54) TWISTED PAIR DATA COMMUNICATION CABLE WITH INDIVIDUALLY SHIELED PAIRS USING DISCONTINUOUS SHIELDING TAPE

(71) Applicant: NEXANS, Courbevoie (FR)

(72) Inventor: Paul Michael Good, New Holland, PA (US)

(73) Assignee: NEXANS, Courbevoie (FR)

( * ) Notice: Subject to any disclaimer, the term of this patent is extended or adjusted under 35 U.S.C. 154(b) by 36 days.

(21) Appl. No.: 16/050,708

(22) Filed: Jul. 31, 2018

(51) Int. Cl.
*H01B 11/08* (2006.01)
*H01B 7/02* (2006.01)

(52) U.S. Cl.
CPC ..... *H01B 11/08* (2013.01); *H01B 7/02* (2013.01)

(58) Field of Classification Search
CPC ..... H01B 11/08; H01B 7/02
USPC ..... 174/103
See application file for complete search history.

(56) References Cited

U.S. PATENT DOCUMENTS

2014/0262411 A1* 9/2014 Hopkinson ..... H01B 11/085 174/34
2018/0033523 A1* 2/2018 Kusuma et al. ..... H01B 7/0216

* cited by examiner

*Primary Examiner* — Timothy J Thompson
*Assistant Examiner* — Charles Pizzuto
(74) *Attorney, Agent, or Firm* — Sofer & Haroun, LLP

(57) ABSTRACT

A LAN cable is provided having a plurality of twisted pairs, a jacket surrounding the twisted pair and at least one discontinuous shield tape having a plurality of separated metal segments. The discontinuous shielding tape is folded and arranged between the plurality of twisted pairs, separating each of said plurality of pairs from one another.

3 Claims, 5 Drawing Sheets

TWISTED PAIR DATA COMMUNICATION CABLE WITH INDIVIDUALLY SHIELED PAIRS USING DISCONTINUOUS SHIELDING TAPE

BACKGROUND

Field of the Invention

This application relates to a data communication cable and shielding tape. More particularly, this application relates to a twisted pair data communication cable with individually shielded pairs using a discontinuous shield tape.

Description of the Related Art

LAN (local area network) or network type communication cables are typically constructed of a plurality of twisted pairs (two twisted conductors), enclosed within a jacket. A typical construction is to have four twisted pairs inside of a jacket, but many other larger pair count cables are available. FIG. 1 is a prior art images of a four pair-twisted pair data communication cable, with a cross filler.

Care is taken to construct these cables in a manner to prevent cross talk both between pairs within the cable and between pairs in adjacent cables. For example, in a typical installation many LAN cables may be arranged next to one another, and signals in the pairs from a first cable may cause interference or crosstalk with another pair in the same or adjacent LAN cable. In order to prevent this, the lay length or twist rates of the pairs in a cable are varied differently from one another. Additionally, when pairs in adjacent cables are running parallel to one another the cross talk can be increased so the pairs within a cable are twisted around one another (helically or SZ stranding) to further decrease interference. Spacing elements can also be used so that the jacket is spaced apart from the pairs so that pairs in adjacent cables are as far away as possible.

Also, to combat internal cross talk between the pairs within a cable, separator and cross filler elements may be used to further separate the pairs within the cable. FIG. 1 is a prior art image of a four pair-twisted pair data communication cable, with a cross filler.

In addition to the above issues additional cross-talk reduction, from both internal and external interference, can be achieved with shielding. LAN cable shielding is usually in the form of a foil that is wrapped around the pairs inside the cable, under the jacket. This metal foil is usually wrapped around the assembled core of twisted pairs prior to jacketing and is constructed of suitable metals, for example aluminum. FIG. 1 likewise shows a typical prior art shield.

Although the shield is effective for preventing alien crosstalk and other external signal interferences, the shield must be grounded to the connector in order to meet safety regulations. This is a time consuming step that increases the cost to install the shielded cable. One typical example requires a drain wire to be helically coiled around the shield which also increases the overall cable cost.

In the prior art, there have been proposals to mitigate the above effect by providing a discontinuous shielding tape having periodic breaks in the shield. FIG. 2 shows one example of discontinuous shielding tape with triangular shaped foil segments. This design for the shield prevents any signals or interference that collect in the shield from extending continuously from end to end in the cable, obviating the need for grounding the shield.

In some prior solutions, such as Category 7, 7A & 8 (ANSI/TIA-568) twisted pair cables have full shields around each pair to meet the strict bandwidth requirements, but these arrangements are difficult to terminate in connectors. There are likewise category 6A solutions that currently use a discontinuous shield around the entire cable core to reduce unwanted coupling between adjacent cables, but that arrangement offers no benefit for excessive unwanted internal signal coupling between pairs in the same cable.

OBJECTS AND SUMMARY

The present arrangement combines the use of discontinues shields and cross filler separation to provide individually shielded pairs with a twisted pair LAN cable. By forming a separation between the pairs internally within the cable, the individual pairs are isolated from one another. Such separation is implemented via one or more discontinuous shields to form the internal separation, by folding and arranging a discontinuous shielded tape around the pairs. This arrangement has the benefit of individual shield/isolation for internal cross talk prevention and is achieved without the need for grounding.

To this end a LAN cable is provided having a plurality of twisted pairs, a jacket surrounding said twisted pairs, and at least one discontinuous shield tape having a plurality of separated metal segments. The discontinuous shielding tape is folded and arranged between the plurality of twisted pairs, separating each of the plurality of pairs from one another.

BRIEF DESCRIPTION OF THE DRAWINGS

The present invention can be best understood through the following description and accompanying drawing, wherein.

DETAILED DESCRIPTION

Figure 1:
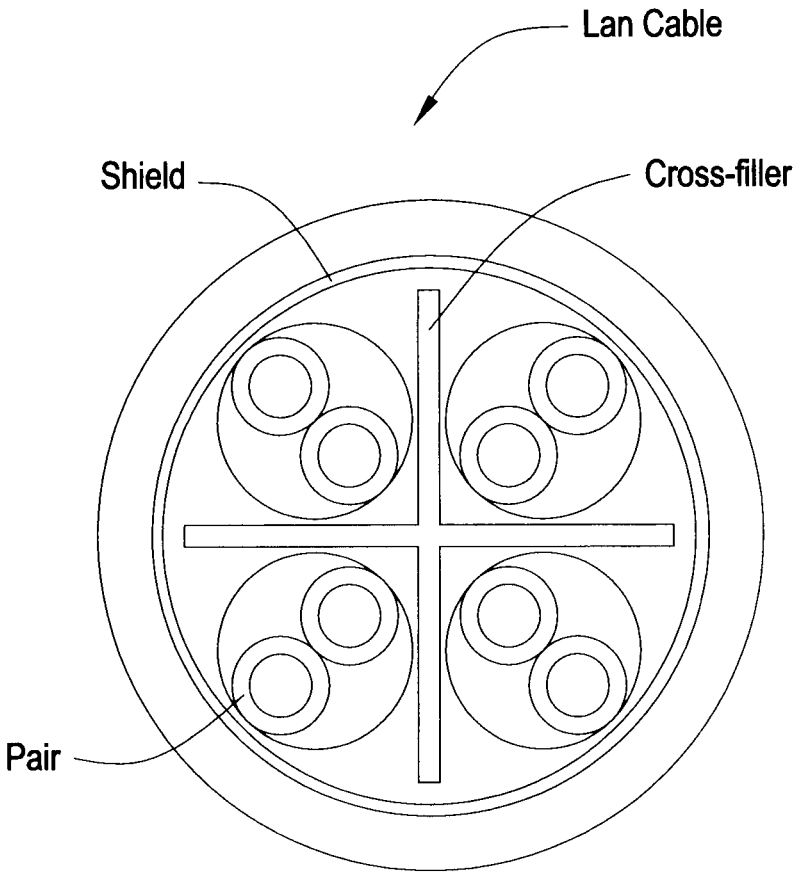
FIG. 1 (Prior Art)
FIG. 1 is a prior art image of a twisted pair LAN cable with a cross filler.
Figure 2:
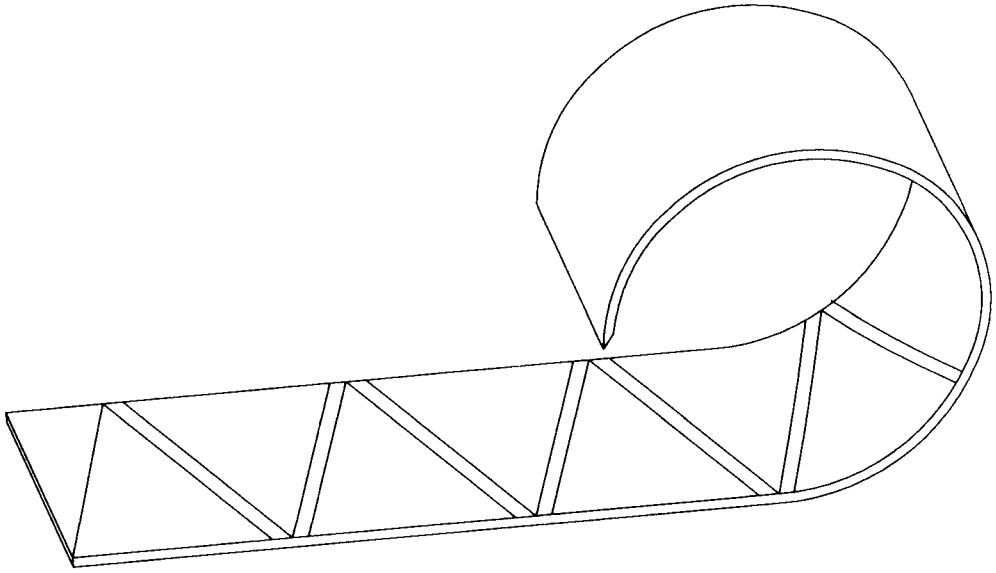
FIG. 2 (Prior Art)
FIG. 2 is a prior art image of discontinuous shield tape for use in LAN cables.
Figure 3:
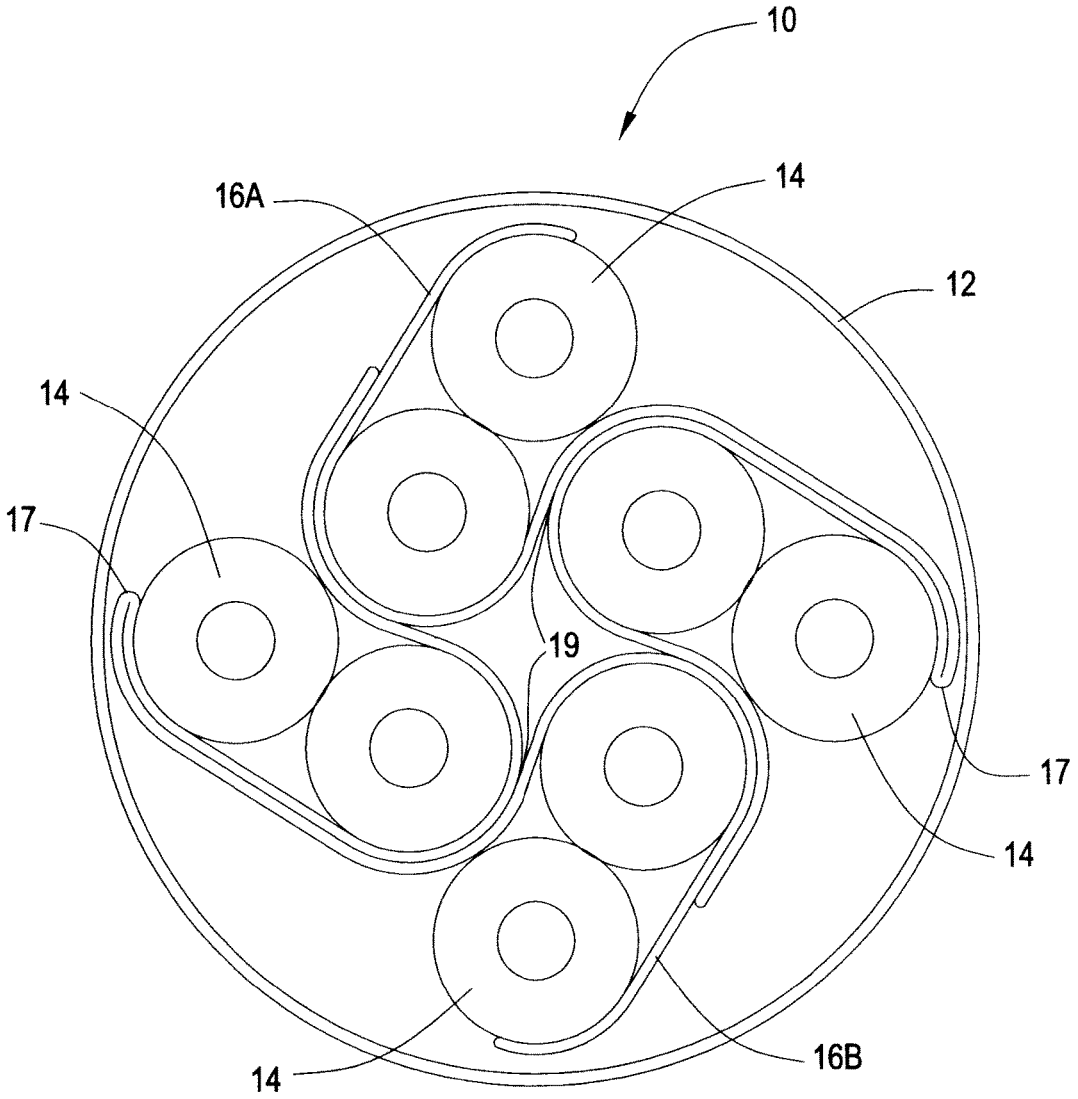
FIG. 3 is a twisted pair LAN cable having individually separated pairs using two discontinuous shielding tapes from any one of FIGS. 4-8 and **9*a*-9*d***, in accordance with one embodiment.
Figures 4, 5, 6, 7, 8:
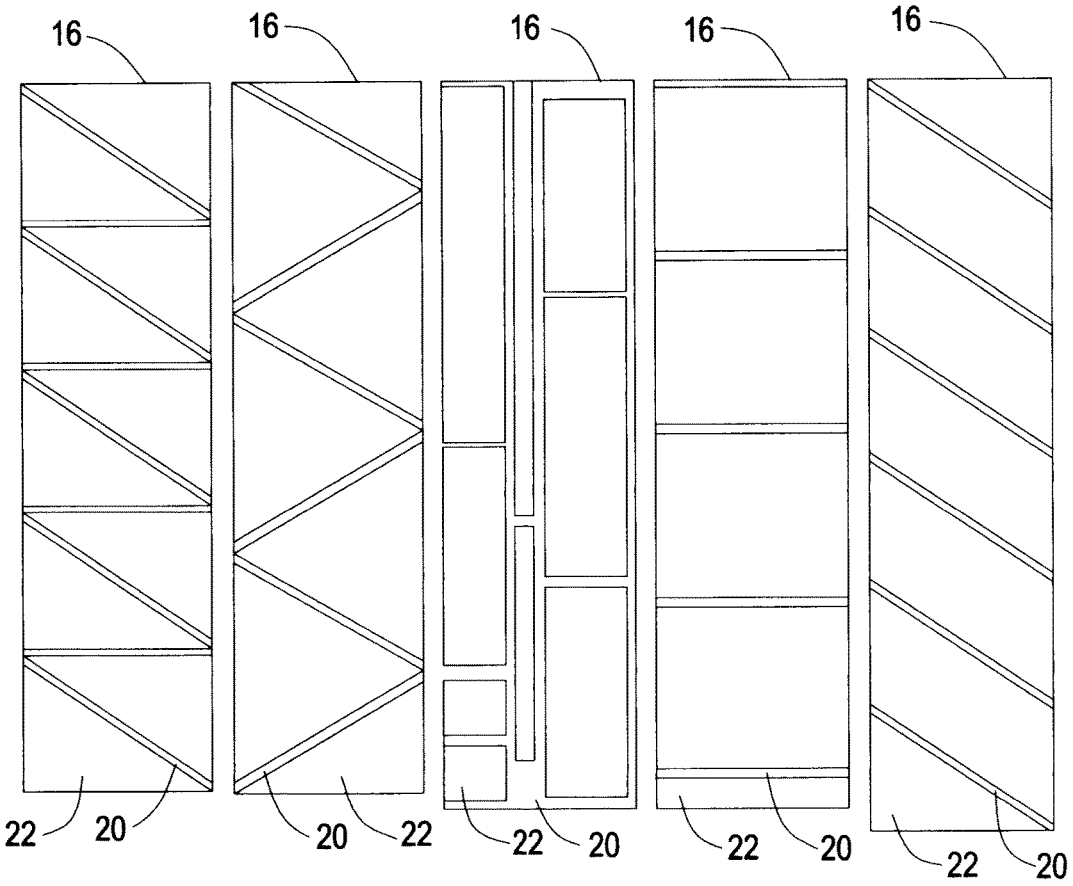
FIGS. 4-8 are discontinuous shielding tapes for use in accordance with one embodiment; and FIGS. **9*a*-9*d*** are side elevations of discontinuous shielding tapes for use in accordance with one embodiment.

In one embodiment, as illustrated in FIG. 3, a twisted pair cable 10 is provided with a jacket 12, four twisted pairs 14 and two shield tapes **16*a* and 16*b*. Shield tapes 16*a* and 16*b*, each contact 2 pairs 14 in cable 10, with partial overlap with the other two pairs 14. Functionally, the combined tapes 16*a* and 16*b* function as a cross separator isolating each pair 14 in cable 10 from the other three pairs. Moreover, tapes 16 at least partially surround an outer portion of each of the four pairs 14** to further protect from unwanted external interference. Such a cable may be used to achieve higher category bandwidth standards under the applicable TIA-568 or IEC 61156 standards.

As shown in FIG. 3, each of tapes **16*a* and 16*b* have a fold point 17 where tapes 16 are folded back against itself longitudinally, and further each have a Y-shaped separation 19 where each of tapes 16 separate from the themselves. As such, each of tapes 16*a* and 16*b* have a portion that is folded against itself and a portion that is separated from itself and partially overlapping the other tape at its portion where it is likewise separated from itself as shown in FIG. 3. This fold point 17 is created prior to cable assembly and is at least partially independent from the twisting of said tapes 16 into the cross-shaped positioning around pairs 14**.

Such partially folded tapes 16*a* and 16*b* may be applied in such a manner as interposed between pairs 14 because they can be assembled faster than other arrangements such as when applying an individual tape over each pair during separate operations. Also, a cable 10 such as that shown in FIG. 3, is more flexible than a cable that uses a separate shield over each pair in its cable.

To interpose such partially folded tapes 16*a* and 16*b* between pairs 14 in cable 10 as shown in FIG. 3, folded tapes 16*a* and 16*b* are passed through a series of rollers on the cable assembly line which interposes and twists tapes 16, at the appropriate distance from crease/fold 17, and forms tapes 16 into curvilinear quadrilateral compartments around pairs 14 as shown. A closing die or series of physical arrangement dies on the cable assembly line complete the cable core (pairs 14 and tapes 16) prior to the application of jacket 12. In some embodiments, fold 17 can be made to create either symmetric (as shown) or non-symmetric tape segments (not shown) in tapes 16*a* and 16*b* in reference to the lengths of tape extending on each side of fold 17/separation 19.

Turning to the structure of tapes 16, FIGS. 4-8 each show a longitudinal plan view of tape 16. Each tape 16 has a substrate or nonconductive portion 20 made from a polymer tape such as Nylon or other suitable material. Each non-conductive portion includes a series of non-contiguous foil/metal elements 22. Foil elements 22 can be of various shapes and arrangements as show in FIGS. 4-8. It is such tapes 16 with non-conductive and conductive portions 20/22 that are implemented as tapes 16*a* and 16*b* as shown in FIG. 3. In one embodiment tapes 16 are approximately 0.001"-0.015" thick and 0.250"-3.100" wide (between the longitudinal edges).

In one embodiment the separations between foil elements 22 (non-conductive substrate 20 only) are generally dimensioned according to the ordinary standards for discontinuous shielding tapes. The separations (and foil segment 22 sizing) are generally dimensioned appropriate for the cable being manufactured based on the desired electrical characteristics. For example, the separation between foil segments 22 allow coupling of a narrow range of frequencies between twisted pairs 13 and the periodicity of their occurrence along tapes 16 allows for the power coupled through them to sum up along the length of cable 10. Therefore, the spacing between metal elements 22 along substrate 20 are selected to avoid coupling of frequencies within the band of operation of the applications expected to function across pairs 16 of cables 10.

It is noted that tapes 16*a* and 16*b*, as shown in FIG. 3 are folded longitudinally and, at parts, overlap with one another when arranged around pairs 14. In order to prevent foil segments 22 from the same tape 16*a* possibly touching one another after folding, or from touching a segment 22 on a different tape 16*b* where there is overlap between tapes 16, each of tapes 16*a* and 16*b* have a composition, and longitudinal fold point that prevents the creation of an accidental continuous electric path that would otherwise require grounding.

Figure 9A:
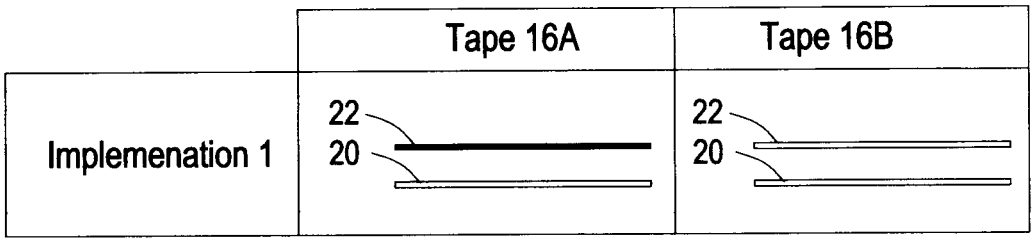

FIG. 9*a* shows tapes 16*a* and 16*b*, such as those shown in FIGS. 4-8, with a non-conductive layer 20 and conductive elements/layer 22. Such tapes 16*a* and 16*b* as shown in FIG. 3 are folded longitudinally along their length before being arranged within cable 10.

In one arrangement, tapes 16*a* and 16*b* when folded at fold points 17 are folded such that conductive segments 22 face outward and non-conductive substrates 20 would face inwards towards one another within fold 17. This prevents segments 22 on one of tapes 16 from touching subsequent segments on the same tape 16 (preventing the generation of a continuous conducting path because of the fold). Likewise, having metal segments 22 facing outward at longitudinal fold 17, makes it such that when tape 16 segments that overlap and touch segments from the other tape 16 (after separation 19 as shown in FIG. 3) the metal segments 22 on both tapes 16 face away from one another again preventing the generation of a continuous conducting path.

In an alternative arrangement using tapes 16*a* and 16*b* shown in FIG. 9A (and FIGS. 4-8), the conductive elements 22 can be inwardly facing one another at folds 17. However, in such arrangements the longitudinal folds 17 as shown in FIG. 3 would need to be made in a manner that is parallel with the spacings between subsequent metal elements 22 to avoid an unwanted continuous conducting path along tapes 16. Moreover, the spacing between metal segments 22 should be likewise distanced within a set tolerance to prevent accidental overlap between subsequent metal segments 22.

Figure 9B:
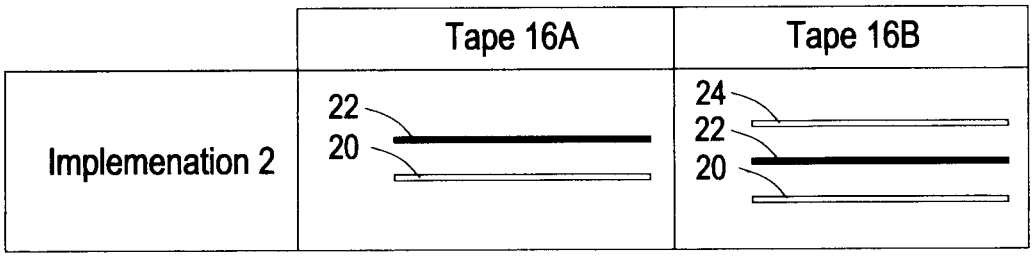

In another embodiment as shown in FIG. 9*b*, one tape 16*b* can have an additional non-conductive layer 24 disposed over metal elements 22 so that metal elements 22 are sandwiched between two non-conductive layers to further prevent any accidental conductive paths when tape 16*b* contacts 16*a* at certain portions within cable 10. Moreover extra layer 24 of non-conductive material is beneficial because it doesn't matter which way tape 16*b* is folded along longitudinal fold 17 and they offer less resistance to the rollers during the forming process around pairs 14.

Figure 9C:
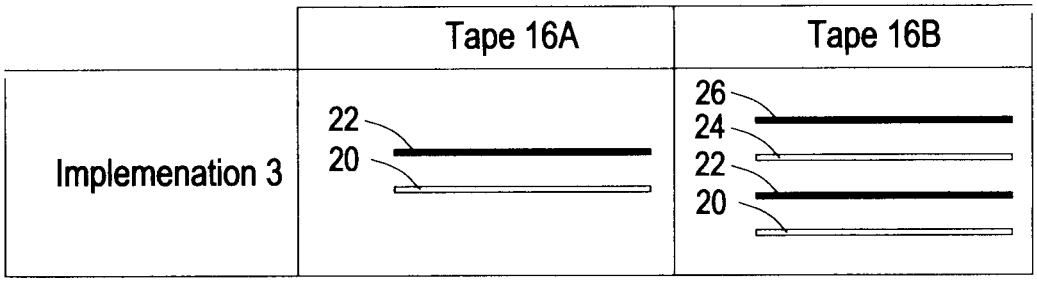

In another embodiment as shown in FIG. 9*c*, tape 16*b* has both an additional non-conductive layer 24 and an additional discontinuous conductive layer 26. Additional layer 26 of conductive material offers greater shielding properties. A tape with a single layer of conductive surface 22 may cause spikes to appear in various measurements such as impedance, return loss, balance and alien crosstalk. The extra layer 26 of conductive elements prevents these spikes if the design specs for cable 10 allow for the additional layers. The tape arrangement for tapes 16*a* and 16*b* would be folded similar to that in FIG. 9*a* (and FIG. 3).

Figure 9D:
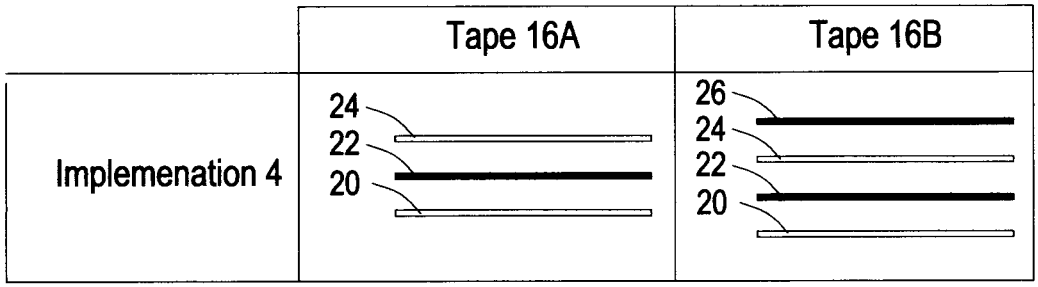

In another embodiment as shown in FIG. 9*d*, tape 16*b* has both an additional non-conductive layer 24 and discontinuous conductive layer 26. Tape 16*a* has just the additional non-conductive layer 24. Such an arrangement combines the benefits of FIGS. 9*b* and 9*c* as discussed above.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A LAN cable comprising:

four twisted pairs of insulated conductors;

a jacket surrounding said twisted pairs; and at least two discontinuous shield tapes each having a plurality of separated metal segments, wherein said discontinuous shielding tapes are folded and arranged between said four twisted pairs in a partially overlapping manner, separating each of said four pairs from one another.

2. The LAN cable as claimed in claim 1, wherein said discontinuous shielding tapes are constructed from a substrate layer and a plurality of separated metal elements disposed thereon.

3. The LAN cable as claimed in claim 2, wherein said discontinuous shielding tapes are folded longitudinally with said separated metal elements outwardly facing and said non-conductive substrate folded onto itself.

* * * * *